United States Patent [19]

Quintana

[11] 3,981,400

[45] Sept. 21, 1976

[54] TEXTILE PACKAGE

[75] Inventor: Michael A. Quintana, Methuen, Mass.

[73] Assignee: Malden Mills, Inc., Lawrence, Mass.

[22] Filed: Sept. 30, 1975

[21] Appl. No.: 617,995

[52] U.S. Cl. ..... 206/407; 206/408; 242/118.61

[51] Int. Cl.[2] ..... B65D 85/67

[58] Field of Search.... 206/308, 316, 389, 395–396, 206/407–408, 413–415; 242/68.5–68.6, 118.61

[56] References Cited

UNITED STATES PATENTS

| | | | |
|---|---|---|---|
| 1,114,660 | 10/1914 | West | 206/407 X |
| 2,139,557 | 12/1938 | Moretti | 242/118.61 |
| 2,922,516 | 1/1960 | Kessler | 206/408 |
| 2,957,642 | 10/1960 | Benoit | 242/118.61 |
| 2,996,265 | 8/1961 | Bieber et al. | 242/118.61 |
| 3,039,602 | 6/1962 | Kessler | 206/407 |
| 3,521,833 | 7/1970 | Ridgeway et al. | 242/118.61 |

*Primary Examiner*—Steven E. Lipman
*Attorney, Agent, or Firm*—Gottlieb, Rackman, Reisman & Kirsch

[57] ABSTRACT

There is disclosed a textile package which offers the advantages of strength, ease of assembly, and low cost. A plastic hub is passed through a hole in each end panel. The hub consists of a flat section for bearing against the outer face of an end panel, a large central sleeve which passes through the hole in the end panel and is inserted into one end of a central connecting tube, and several peripheral lugs which pass through smaller holes in the end panel which surround the central hole. The hub is secured to the end panel by nuts on the inner face of the end panel placed over the lugs, and the central sleeve is secured to the connecting tube by circumferential sharp-edged ridges. Looking at the package from outside an end panel, the central sleeve is hollow as are one or more of the lugs. This permits each end panel to be fixed to a mandrel so that the package can be turned as fabric is wound around the connecting tube. After the winding operation, a cardboard wrapper is placed around and stapled to the edges of the end panels.

4 Claims, 6 Drawing Figures

1 of 2

2 of 2

TEXTILE PACKAGE

This invention relates to textile packages, and more particularly to a textile package which is made of end panels and a connecting tube.

It is standard in the textile industry to construct a package for fabric from a pair of end panels and a central connecting tube. The end panels are mounted on mandrels which are turned; as the package is turned, fabric is wound around the central tube. After a roll of fabric has been thus wound, a cardboard wrapper is placed around the package and stapled to the end panels.

The package consisting of the end panels and the connecting tube is generally not made as a unitary structure. Conventional textile packages are very large — many feet in length with each edge of a typical square-shaped end panel being perhaps 2 feet long — and it would be exceedingly costly to ship unitary structures of this type from a package manufacturing plant to a mill. For this reason, the end panels and the connecting tubes are shipped disassembled, and the packages are constructed from these components at the mill where they are used.

It is, of course, necessary that when the end panels are secured to the connecting tube the resulting package be strong enough for shipment therein of a heavy roll of fabric. In order to attach each end panel to the connecting tube, there have been employed in the prior art devices which have been costly, either in materials or in labor, or alternatively devices which have resulted in packages of less than the desired strength.

It is an object of my invention to provide a textile package which is of high strength, low cost, and relatively easy to assemble.

In Ridgeway et al U.S. Pat. No. 3,521,833, issued on July 28, 1970 and entitled "Spool with Plastic Connectors", there is disclosed a spool which consists of a hollow connecting tube, a pair of disc heads each having a central hole, and a pair of flanged sleeve-type connectors. Each connector is inserted through the central hole in a disc, with the flange abutting against the outer face of the disc and with the sleeve being inserted into one end of the connecting tube on the other side of the disc. One of the problems with this type of arrangement, were it to be used in the packaging of heavy rolls of fabric, is that the connectors are not fixed to the discs. Moreover, while the connector sleeves are telescoped so that they fit snugly into the central tube, there is no provision for preventing the connectors from slipping out of the tube. The Ridgeway et al spool, while being relatively inexpensive and easy to assemble, is not satisfactory for supporting heavy fabric rolls.

In accordance with the principles of my invention, each end panel, in addition to having a central hole through which a connector sleeve passes, has a plurality of smaller holes spaced around the central hole. On the inner face of the connector flange, on that side from which the central sleeve extends, there is provided a plurality of peripheral lugs. (At least one such lug is necessary.) These lugs fit through the smaller holes in the end panel when the central sleeve is inserted through the central hole. By pressing a Tannerman nut, or some equivalent locking element, on the end of each lug against the inner face of the end panel, the connector element is attached to the end panel such that they do not separate even under rough handling and they cannot rotate around their common axis relative to each other.

The sleeve itself is provided with a series of circumferential ridges. These ridges have sharp corners and are tapered from the sharp corners toward the front end. The sleeve as a whole is tapered as well, with the diameters of the circumferential ridges increasing from the forward end of the sleeve to the flange. This permits each sleeve to be inserted easily into one end of the connecting tube with the application of sufficient pressure. By making the diameters of the circumferential ridges near the flange slightly larger than the inner diameter of the tube, the tube is deformed slightly with the ridges penetrating into the cardboard of the tube and the sharply defined edges of the ridges aiding to prevent the withdrawal of the sleeve from the tube.

After the fabric is wound around the connecting tube, the conventional cardboard wrapper is applied to the package and stapled to the edges of the end panels.

Looking at each flange from outside the package, both the central sleeve and the lugs are hollow. This permits a mandrel having a conforming shape to support each connector and to insure that the package turns with the mandrels during the fabric winding operation. Each mandrel includes not only a central sleeve for fitting within the hollowed-out connector sleeve, but also one or more lugs for fitting in the hollowed-out flange lugs to insure that there is no slippage in the end panels relative to the mandrel.

Further objects, features and advantages of my invention will become apparent upon consideration of the following detailed description in conjunction with the drawing, in which.

Figure 1:
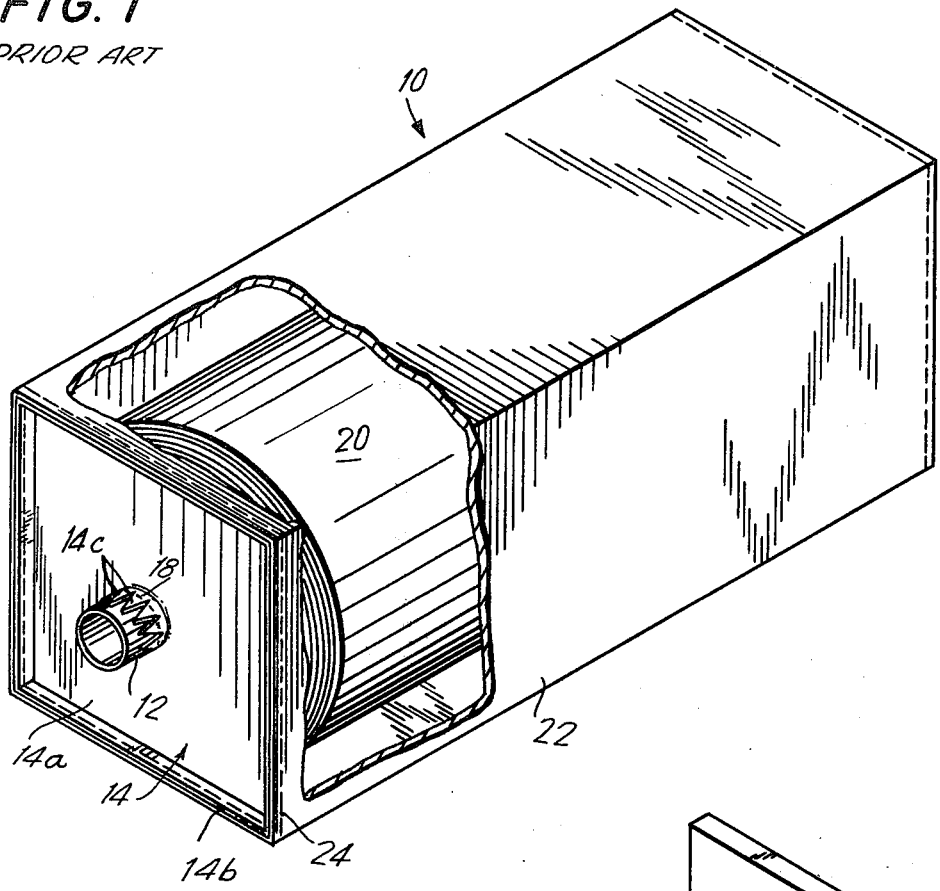
FIG. 1 PRIOR ART
FIG. 1 is a perspective view, shown partially broken away, of a present-day widely used textile package.

The prior art package 10 of FIG. 1 consists of two cardboard end panels 14 and a hollow connecting tube 12. At the center of each end panel 14 there is a die-cut "starburst" hole. As tube 12 is inserted into this hole from the inner face of each end panel, tabs **14*c* bend and surround the tube. The two end panels are typically held in a jig to insure proper alignment, and then an operator manually staples the tabs 14*b* to the tube at each end of the package. The position of the staples is indicated by the numeral 18**.

As the end panels are turned on mandrels, fabric 20 is wound around the connecting tube 12. After the fabric is wound, a cardboard wrapper 22 is positioned around the package. Each end panel 14 has bent edges **14*b*, the edges being bent toward outer face 14*a*. At the end of the packaging operation, the wrapper 22 is stapled to the four bent edges of each end panel, the numeral 24** depicting the positions of these staples.

Although the materials cost of the package of FIG. 1 is quite low, it is necessary for an operator to manually staple the tabs 14*b* to tube 12 at each end of the package. Quite apart from the labor required to staple the various tabs 14*b* to tube 12, the resulting package sometimes does not stand up to the rough handling which is encountered during shipment. It has been found that the staples 18 may not be sufficient to prevent tube 12 from rotating or moving in the axial direction relative to the end walls.

Figure 3:
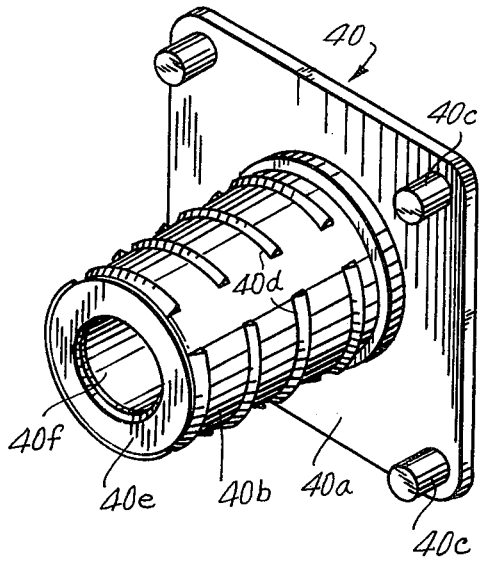
FIG. 3 is a perspective view illustrating the connector element 40 utilized in assembling two end panels to the connecting tube in constructing the package of the invention.

The package of the invention, on the other hand, utilizes a pair of plastic connector elements 40, shown most clearly in FIG. 3. Each connector element includes a flat flange section 40*a* and a central sleeve 40*b*. Around the central sleeve there are circumferential ridges 40*d*, the cross-section of which can be seen most clearly in FIG. 4. The central sleeve is tapered from the forward end 40*e* back toward flange 40*a*, also as seen most clearly in FIG. 4. At the four corners of flange 40*a* there are provided four lugs 40*c*, each facing inwardly in the direction of the sleeve.

Figure 2:
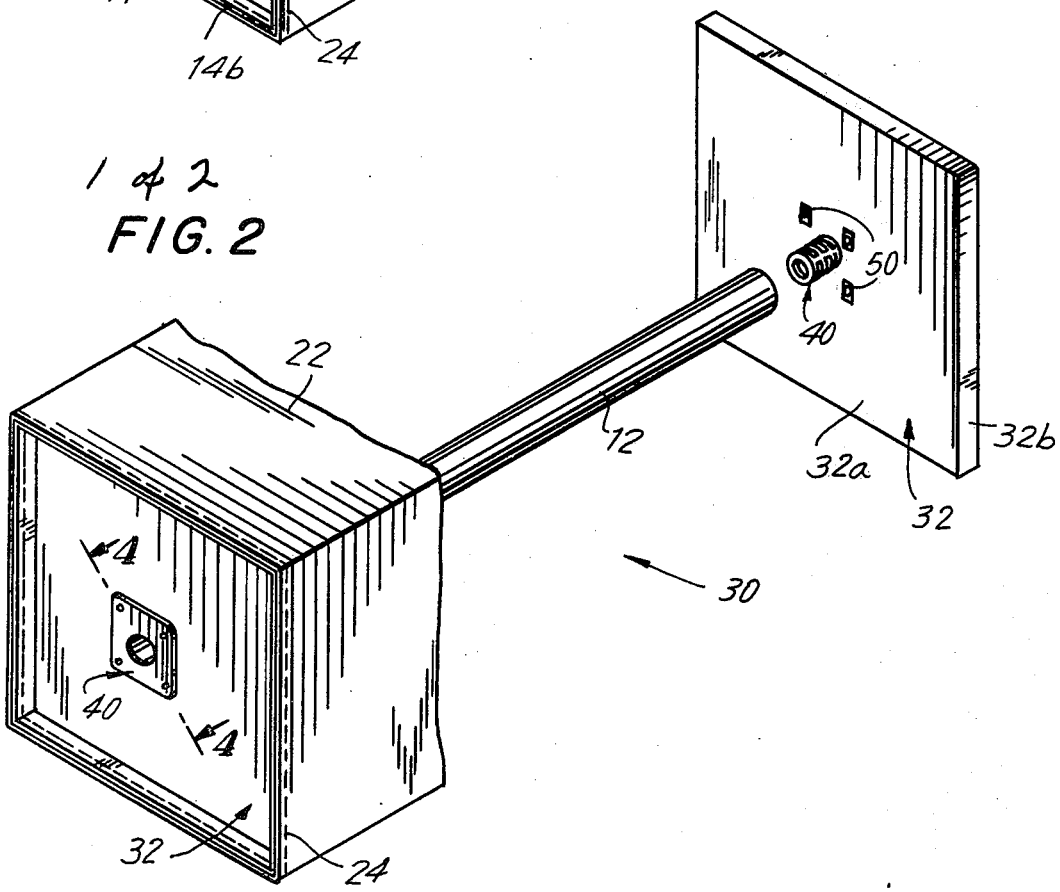
FIG. 2 is an exploded, partially broken away, view of a package constructed in accordance with the principles of the invention.

Referring to FIG. 2, each end panel 32 is similar to an end panel 14 in FIG. 1; each end panel is square-shaped and has four bent edges 32*b*. There are two major differences, however. First, each end panel has a circular central hole rather than a hole cut in a starburst pattern. Second, four smaller holes are cut out in end section 32*a*. These holes are disposed around the central hole and are positioned such that when sleeve 40*b* of a connector element is inserted through the central hole, the four lugs 40*c* pass through the four smaller holes in the end panel. This is shown most clearly in FIG. 4.

Figure 6:
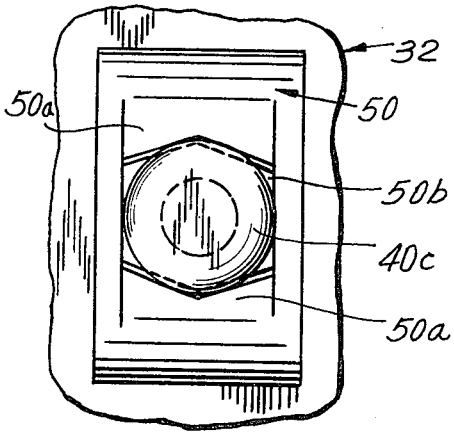
FIG. 6 is a view looking in the direction of line 6—6 of FIG. 4.

The connector 40 is secured to end panel 32 simply by pressing a Tannerman nut 50, or some comparable locking element, over the lugs 40*c* on the inner face of the end panel. This is shown most clearly in FIGS. 4 and 6. Each Tannerman nut, as is known in the art, includes two tabs 50*a* for tightly gripping a lug which is passed through a central cut-out 50*b*. The provision of the lugs and nuts securely fixes each connector to an end panel both axially and radially.

Figure 4:
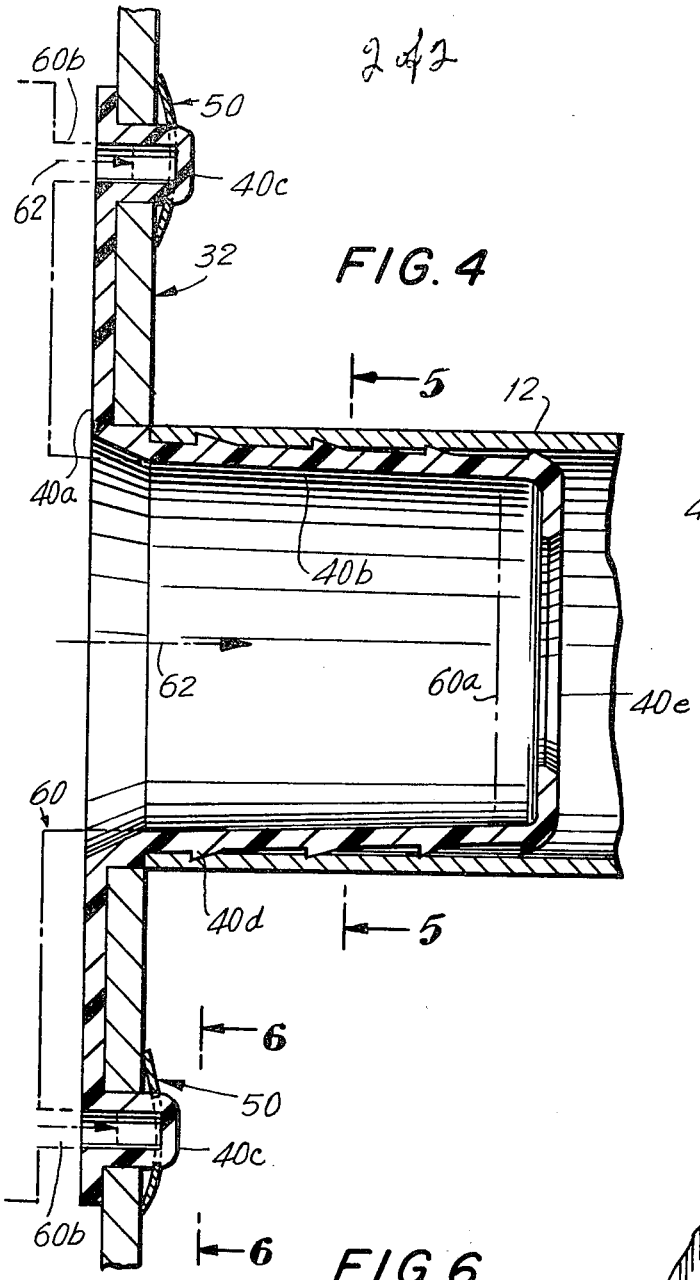
FIG. 4 is a sectional view taken through the line 4—4 of FIG. 2.

It will be noted in FIG. 4 that looking at the connector from outside the package (that is, from the left in FIG. 4), each lug 40*c* and sleeve 40*b* is hollow. This permits a mandrel, shown by phantom line 60, to be inserted into the connector by moving it in the direction of arrows 62. The central cylindrical element 60*a* of the mandrel fits within the sleeve and provides the primary support for the package at each end. The smaller cylindrical elements or lugs 60*b* fit into one or more of the lugs 40*c*. This insures that as the mandrel is turned during the fabric winding operation, the connector element turns with it and does not slip relative to the central cylindrical element 60*a*.

Figure 5:
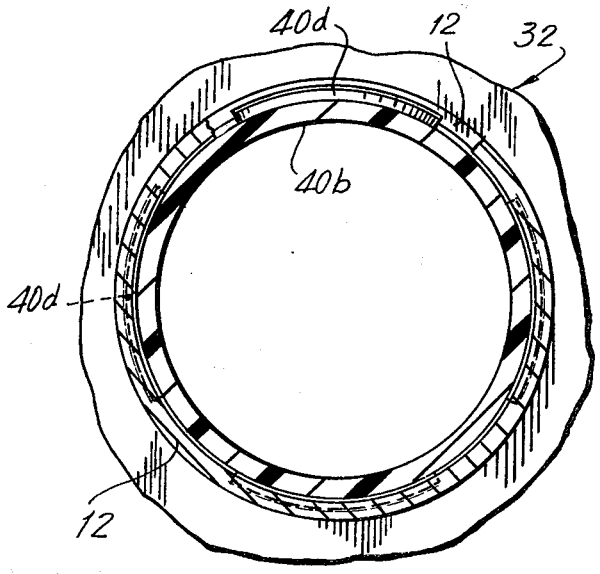
FIG. 5 is a sectional view, shown partially broken away, taken through the line 5—5 of FIG. 4.

FIGS. 4 and 5 depict the manner in which the ridges 40*d* on sleeve 40*b* grip connecting tube 12. Because the sleeve is tapered, the forward end 40*e* of the sleeve is easily pushed into an end of the tube, the outer diameter of the forward end being smaller than the inner diameter of the tube. But due to the taper of the sleeve, the outer diameter of the ridges 40*d* toward the back of the connector are larger than the inner diameter of the tube. Although the connector can be inserted into the tube easily with the application of sufficient force, the tube simply deforming slightly, because of the sharp-cornered edge on each ridge 40*d* it is exceedingly difficult to pull the connector out of the tube. This force-fit adds to the rigidity of the overall structure.

Although in the illustrative embodiment of the invention each ridge is formed of four 60°-sections, that is only because it is easier to mold a plastic connector element having such a shape. It is certainly possible to provide ridges which extend 360° around the sleeve.

At the end of the fabric-winding operation, a conventional wrapper 22 is secured to the end panels by staples 24, as in prior art practice and as shown in FIG. 2.

It should be noted that the forward end 40*e* of the connector is provided with a central hole 40*f*. The purpose of the hole is to allow the introduction of a bar through the center of the package to facilitate turning of the package on the bar and the unwinding of the fabric roll.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

What I claim is:

1. A textile package comprising a pair of end panels having edges; each of said end panels having a central hole therein and at least one additional hole positioned between said central hole and an edge thereof; a pair of connector elements each including a flat flange, a central sleeve projecting from the inner face of said flange and at least one lug projecting from said inner face in the direction of said sleeve, each said sleeve being inserted in the central hole of an end panel with said at least one lug passing through said at least one additional hole in each end panel; at least one locking means on said at least one lug on each connector element securing the connector element to each end panel; a hollow connecting tube positioned between said connector elements with the sleeves being received in the hollow ends thereof; the sleeve on each connector element being tapered with the diameter of its end furthest away from the flange being smaller than the inner diameter of said tube and having a plurality of sharp-cornered circumferential ridges, the outer diameter of at least one circumferential ridge near the flange being larger than the inner diameter of said tube so that a force-fit is achieved by said at least one circumferential ridge deforming the tube slightly and opposing the withdrawal of the sleeve from the tube; and a wrapper extending from one end panel to the other and being secured to the edges of both end panels.

2. A textile package in accordance with claim 1 wherein the sleeve and said at least one lug on each connector element is hollow in a direction looking at an end of the package whereby a mandrel having a conforming shape including both a central sleeve and at least one lug can be placed up against the connector element at each end of the package to control turning of the package during a fabric winding operation.

3. A textile package in accordance with claim 2 wherein the inner end of each of said sleeves has a hole therein for permitting a bar to be inserted all the way through said tube and said connector elements.

4. A textile package in accordance with claim 1 wherein the inner end of each of said sleeves has a hole therein for permitting a bar to be inserted all the way through said tube and said connector elements.

* * * * *